US006539930B2

(12) United States Patent
Inagaki

(10) Patent No.: US 6,539,930 B2
(45) Date of Patent: Apr. 1, 2003

(54) IGNITION APPARATUS FOR INTERNAL COMBUSTION ENGINE

(75) Inventor: Hiroshi Inagaki, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/022,696

(22) Filed: Dec. 20, 2001

(65) Prior Publication Data

US 2002/0079900 A1 Jun. 27, 2002

(30) Foreign Application Priority Data

Dec. 21, 2000 (JP) ..... 2000-388767
Aug. 31, 2001 (JP) ..... 2001-263784

(51) Int. Cl.[7] ..... F02P 1/00
(52) U.S. Cl. ..... 123/655
(58) Field of Search ..... 123/655, 650, 123/594, 434; 324/378

(56) References Cited

U.S. PATENT DOCUMENTS 4,407,259 A * 10/1983 Abo ..... 123/620
6,116,226 A * 9/2000 Vogel ..... 123/609
6,348,797 B1 * 2/2002 Shimizu et al. ..... 324/399

FOREIGN PATENT DOCUMENTS

| | | |
|---|---|---|
| JP | 04-191465 | 7/1992 |
| JP | 05-157001 | 6/1993 |
| JP | 08-177703 | 7/1996 |
| JP | 10-238446 | 9/1998 |
| JP | 2001-173548 | 6/2001 |

* cited by examiner

*Primary Examiner*—Bibhu Mohanty
(74) *Attorney, Agent, or Firm*—Morgan, Lewis & Bockius LLP

(57) ABSTRACT

In an ignition apparatus for internal combustion engine, since a current caused to flow by an induced voltage generated at both ends of a secondary winding L2 when starting conduction to a primary winding L1 is checked from the conduction by diode for prevention of a reverse current 31, a spark discharge is not generated between the electrodes 13*a*–13*b* of the spark plug 13 when starting the conduction to a primary winding L1. After ending the spark discharge, the ionized current is generated between the electrodes of the spark plug by impressing the induced voltage (the ionized current generating voltage) created at both ends of the air-fuel mixture by a residual energy of the ignition coil 15.

9 Claims, 6 Drawing Sheets

IGNITION APPARATUS FOR INTERNAL COMBUSTION ENGINE

BACKGROUND OF THE INVENTION

1. Field of the Invention

The present invention relates to an ignition apparatus for internal combustion engine. More specifically, this invention relates to the ignition apparatus that has a function to generate a firing voltage (Hereinafter referred to as "a high voltage for firing") in the ignition coil for generating the spark discharge between electrodes of a spark plug and to supply an ionized current after a spark discharge.

2. Description of the Related Art

In internal combustion engines used in such as vehicle engines, when an air-fuel mixture is ignited by a spark discharge that is generated by a spark plug, ion is generated following this firing. Therefore, after the air-fuel mixture is ignited by the spark discharge of the spark plug, an ionized current flows by supplying a voltage between electrodes of the spark plug. As the amount of the generated ion changes with ignited conditions of the air-fuel mixture, the ionized current generating by the generated ion is detected and analyzed, whereby to carry out a misfire detection or knocking detection.

In the conventional ignition apparatus for internal combustion engine, which has a function for generating the ionized current, the spark plug is electrically connected to one end of a secondary winding while a capacitor is provided in series to the other end thereof;

when the spark discharge generates at the spark plug, the capacitor is charged by a spark discharge current (Hereinafter, referred to as "secondary current") flowing in the secondary winding of the ignition coil and the spark plug;

the charged capacitor is discharged after stopping the spark discharge, whereby a voltage is supplied between electrodes of the spark plug through the secondary winding (for example, Japanese Patent Publication NO.Hei4-191465 or Japanese Patent Publication NO.Hei10-238446).

In such an ignition apparatus for internal combustion engine, a Zener diode is provided in parallel to the capacitor for preventing the capacitor from destruction, which is caused by an overcharge thereof. Moreover, in the ignition apparatus, a voltage at both ends or the capacitor is limited to be constant voltage. (100 to 300[V])

Thus, the ignition apparatus for internal combustion engine employing the capacitor as an electric power supply for generating the ionized current does not require to particularly provide an electric power supply (such as battery) exclusively used for supplying the ionized current. Therefore, parts of the ignition apparatus are reduced and miniaturization is realized.

However, in the ignition apparatus for internal combustion engine of the structure which discharges the capacitor charged with the secondary current flowing while generating a spark discharge at the spark plug, when turning on electricity in the primary winding for accumulating magnetic flux energy in the ignition coil, a high voltage (several kV) which has a opposed polarity to the high voltage for firing, is generated at the secondary winding, whereby the spark discharge of the spark plug is generated before a normal firing time. Therefore, this may bring about a misfire of the air-fuel mixture.

The above-mentioned ignition apparatus is structured such that a conductive path of the secondary current causes a current to be conductive in both directions, whereby the ignition apparatus makes it possible to charge the capacitor connected in series to the conductive path of the secondary current when generating the spark discharge at the spark plug and to discharge the capacitor when generating the ionized current between the electrodes of the spark plug. The ignition apparatus is structured such that the conductive path of the secondary current causes current to be conductive in both directions. Therefore, in such an ignition apparatus for internal combustion engine which is accompanied with changing of magnetic flux density in the ignition coil at starting conduction to the primary winding, an induced voltage having an opposed polarity thereof at the time to cut off the primary current, is generated at both ends of the secondary winding.

In case the induced voltage generated at the time to cut off the primary current is higher than a voltage value necessary to generate the spark discharge, the spark discharge is generated at the spark plug under a condition where the secondary current flows in a opposed direction to a secondary current flowing at the time of an inherent spark discharge.

Further, under a condition where the conduction of the primary current to the primary winding is constant, the rotation speed of the internal combustion engine is higher, a time of starting the conduction of the primary current to the primary winding is determined at "an earlier period of a crank angle". Herein, "The earlier period of the crank angle" indicates "a time when an internal pressure within a cylinder is low".

It is known that the lower the internal pressure in the cylinder is, the lower the discharge voltage at he spark plug. Therefore, When the internal combustion engine operated at high rotation speed, a misfire of the air-fuel mixture is easy to happen, since the high voltage (several kV) of the opposed polarity to the high voltage for firing, which is generated in the secondary winding. at the time to start a conduction to the primary winding. In order to avoid generating the misfire of the air-fuel mixture at the earlier period ("a time when an internal pressure within a cylinder is low"), it is necessary that a conductive direction in the conductive path of the secondary current is determined to be one direction and a so-called diode for preventing reverse current is provided between one end of the secondary winding and one end of the spark plug so that current is allowed to flow only when the time to cut off the primary current.

However, in case the diode for preventing reverse current is provided between one end of the secondary winding and one end of the spark plug so as to allow only the conduction of the secondary current in the secondary winding when the time to cut off the primary current, the ignition apparatus for internal combustion engine having the function generating the ionized current makes it possible to charge the capacitor by the secondary current, and the current by discharging from the capacitor cannot flow, whereby it is difficult to provide the ionized current between electrodes of the spark plug.

Therefore, the ionized current flowing between the electrodes of the spark plug cannot be detected.

SUMMARY OF THE INVENTION

It is an object of the invention to provide an ignition apparatus for internal combustion engine which can restrain a misfire of the air-fuel mixture caused by generating the spark discharge at the spark plug when the time to start a conduction to the primary winding, and can generate and detect the ionized current between electrodes of the spark plug.

According to the first aspect of the invention, an ignition apparatus for an internal combustion engine comprises:

an ignition coil comprising a primary winding and a secondary winding, wherein the secondary winding has a high voltage side and a low voltage side, and the ignition coil generates a firing voltage supplied to the secondary winding by cutting off a primary current flowing in the primary winding;

a switching device for conducting and cutting off the primary current;

a spark plug connected in series to the secondary winding to form a closing loop, wherein a spark discharge is generated in the spark plug when a secondary current generated by the firing voltage flows in the spark plug;

a diode for preventing a reverse current, connected to a conducting path between the spark plug and the high voltage side, wherein the diode conducts the secondary current when a primary current is cut off, the diode cuts off the secondary current when the primary current starts to flow;

a current detecting device connected in series to the secondary winding and the spark plug; and a supplied voltage limiting device holding a voltage applied to the current, detecting device below a predetermined value, when the firing voltage is generated, wherein an ionized current generating voltage is supplied to the secondary winding by a residual energy when the residual energy is remained in the ignition coil after the spark discharge, the current detecting device detects a current in proportion to the ionized current, which is generated when the ionized current generating voltage is supplied to the spark plug.

In short, in the ignition apparatus for internal combustion engine of the invention, the diode for preventing reverse current is provided in the conductive path connecting the high voltage side of the secondary winding of the ignition coil to the spark plug, thereby to limit the current conductive directions in the conductive path of the secondary current to be one direction.

The diode for preventing reverse current cuts off the conduction by a high voltage generated at both ends of the secondary winding when the time to start the conduction to the primary winding, so that the high voltage generated at both ends of the secondary winding when the time to start the conduction to the primary winding prevents a generation of the spark discharge between electrodes (a center electrode and an earth electrode) of the spark plug.

Further, in the ignition apparatus for internal combustion engine of the invention, the spark plug is supplied with an induced voltage generated at both ends of the secondary winding by residual energy existing in the ignition coil after ending the spark discharge of the spark plug, thereby to conduct the ionized current between the electrodes of the spark plug.

To explain in more detail, the induced voltage generated at both ends of the secondary winding by the residual energy existing in the ignition coil after ending the spark discharge of the spark plug is supplied to the spark plug, and the induced voltage is charged in a floating capacitor existing in the conductive path of the secondary current. The floating capacitor existing in the conductive path of the secondary current includes a floating capacitor of the spark plug. This supplied electric charge to the floating capacitor is utilized to conduct the ionized current between the electrodes of the spark plug.

That is, the induced voltage supplied to both ends of the secondary winding by the residual energy of the ignition coil is used as a voltage for conducting the ionized current to generate the ionized current, and the ignition coil has a function as a power supply for generating the high voltage for firing to generate the spark discharge and as the power supply for generating the ionized current.

Herein, the residual energy existing in the ignition coil when ending the spark discharge of the spark plug, is insufficient for continuing the spark discharge, but has the sufficient amount for generating the ionized current by charging the floating capacitor in the conductive path of the secondary current. That is, the voltage for generating the ionized current at both ends of the secondary winding by the residual energy after ending the spark discharge is around 1 to 5 [kV].

Such a voltage for generating the ionized current at both ends of the secondary winding is higher than a voltage, which is 100 to 300 [V] in the related art, accumulated by a capacitor for generating an ionized current, which is supplied between electrodes of the spark plug. Therefore, a larger ionized current than the one in the related art flows between the electrodes of the spark plug, so that a detection accuracy of the ionized current can be improved.

Further, the induced voltage generated at both ends of the secondary winding after ending the spark discharge. accumulates electric charge in the floating capacitor existing in the conductive path of the secondary current, but the supplied electric charge accumulated in the floating capacitor of the spark plug is prevented from, back-flowing to the secondary winding by the diode for preventing reverse current provided in the conductive path, which connects the high voltage side of the secondary winding to the spark plug. Therefore, the supplied electric charge accumulated in the floating capacitor of the spark plug does not only flow back to the side of the secondary winding but also get consumed, so that the supplied electric charge is utilized for generating the ionized current between the electrodes of the spark plug. In short, the diode for preventing reverse current has a function of avoiding the misfire when the time to start the conduction of the primary winding and also a function of generating the ionized current between the electrodes of the spark plug.

A current detecting means is connected in series to the secondary winding and the spark plug existing in the conductive path of the secondary current. When the ionized current flows between the electrodes of the spark plug, a current flowing in the current detecting means is in proportion to the ionized current flowing between the electrodes, the ionized current can be preferably detected by detecting the current flowing in the current detecting means.

When the high voltage for firing (that is, the spark discharge) is generated, a supplied voltage limiting means limits an supplied voltage to the current detecting means below a predetermined value, thereby it is possible to limit a dropping rate of a supplied voltage to the current detecting means below the predetermined value. The dropping rate of the supplied voltage to the current detecting means is included in the high voltage for firing is generated in the secondary winding. Therefore, the supplied voltage to the spark plug can be prevented from decreasing. It is possible to prevent the misfire without generating the spark discharge and a termination of the spark discharge in a short time period.

According to the first aspect of the invention, a misfire of the air-fuel mixture when the time to start the conduction to the primary winding is prevented, and the internal combustion engine in the present invention maybe avoided from injuries by the misfire of the air-fuel mixture.

In addition, by making use of the induced voltage (the voltage for generating the ionized current) generated by the residual energy existing in the ignition coil after ending the spark discharge of the spark plug, and by serving the diode for preventing reverse current provided in the conductive path connecting the high voltage side of the secondary winding and the spark plug, the ionized current can be generated between the electrodes of the spark plug.

When supplying a voltage between the electrodes of the spark plug for generating the ionized current, in comparison with the case of supplying a voltage such that the center electrode of the spark plug is negative and the earth electrode thereof is positive, in the case of supplying a voltage such that the center electrode of the spark plug is positive and the earth electrode thereof is negative, it is known that a larger ionized current can be generated. This is why an ion is provided with an electron from the earth electrode having a larger surface compared with a surface area of the center electrode, whereby more electrons are exchanged and movable.

From this fact, in the ignition apparatus for internal combustion engine of the invention, it is sufficient that the ignition coil and the spark plug are provided such that the voltage for generating the ionized current generated at both ends of the secondary winding by the residual energy in the ignition coil after ending the spark discharge of the spark plug is supplied in such a manner that the center electrode of the spark plug is positive. The detecting precision of the ionized current can be more heightened thereby.

For accomplishing this effect, when cutting off the conduction of the primary current, the ignition coil (actually, the winding direction of the secondary winding) to be connected to the spark plug is adjusted such that the center electrode of the ignition coil is positive.

As to the current detecting means for detecting a current in proportion to the ionized current, for example, as seen in a second aspect of the invention, the current detecting means is a detecting resistor one end of which is connected to the low voltage side of the secondary winding, while the other end thereof is grounded. The current detecting means detects the voltage between both ends of the detecting resistor, which is in proportion to the ionized current.

Thus, in the detecting resistor one end of which is connected to the low voltage side of the secondary winding, and the other end is connected to the detecting resistor earthed, the voltage in proportion to the ionized current flowing between the electrodes of the spark plug is generated between both ends of the detecting resistor, when supplied the voltage for generating the ionized current to the spark plug in order to conduct the ionized current between the electrodes of the spark plug.

Therefore, by measuring change of the voltage between both ends of the detecting resistor and calculating the current flowing in the detecting resistor on the basis of the measured voltage at both ends and the resistance value of the detecting resistor, the magnification of the ionized current can be detected.

Further, the detecting resistor is grounded at one end thereof, and a potential of the earthed end is maintained predetermined (ground potential (0[V])), and by detecting change of the potential at the end connected to the low voltage side of the secondary winding as a standard potential being the ground potential, the voltage at both ends of the detecting resistor can be preferably detected.

Thus, according to the second aspect of the invention, the magnitude of the ionized current flowing between the electrodes of the spark plug can be detected, and the misfiring of the internal combustion engine and the knocking can be judged by the ionized current detected on the basis of this detecting resistor.

Further, the ignition apparatus for internal combustion engine of the second aspect of the invention is, as set forth in the third aspect of the invention, the supplied voltage limiting means may be structured to include a Zener diode connected in parallel to the detecting resistor in such a mode that an anode is connected between an one end of connecting the low pressure side of the secondary winding and one end of the detecting resistor.

That is, when the voltage at both ends of the detecting resistor is above the breakdown voltage of the Zener diode, the Zener diode makes the current conductive, thereby to limit the supplied voltage to the detecting resister below a predetermined value for limiting the voltage at both ends of the detecting resistor to exceedingly rise. Therefore, the discharge current (the secondary current) flowing when the time to generate the spark discharge does not flow to the detecting resistor but is bypassed by the Zener diode, whereby a property of a spark discharge of the spark plug and a firing of the air-fuel mixture can be maintained well conditioned.

It is sufficient that the breakdown voltage of the Zener diode (the Zener voltage) is set at around dynamic range (for example, around 5[V] or 8[V]) of the ionized current to be detected by the detecting resistor, namely, in response to maximum voltage values at both ends of the detecting resistor, which is generated by the ionized current flowing between the electrodes of the spark plug.

It is thereby possible to preferably realize detection of the ionized current using the detecting resistor. As the Zener diode, cheap ones maybe used where withstand electric power is around 0.1[W] to 1[W].

Thus, depending on the ignition apparatus for internal combustion engine of the invention (the third aspect of the invention), not only the detecting resistor may be protected, but also the misfiring or expiration of the spark discharge in a short time may be avoided, so that the firing facility to the air-fuel mixture can be prevented from reducing and the operating facility of the internal combustion engine can be prevented from lowering.

DESCRIPTION OF THE PREFERRED EMBODIMENTS

Figure 1:
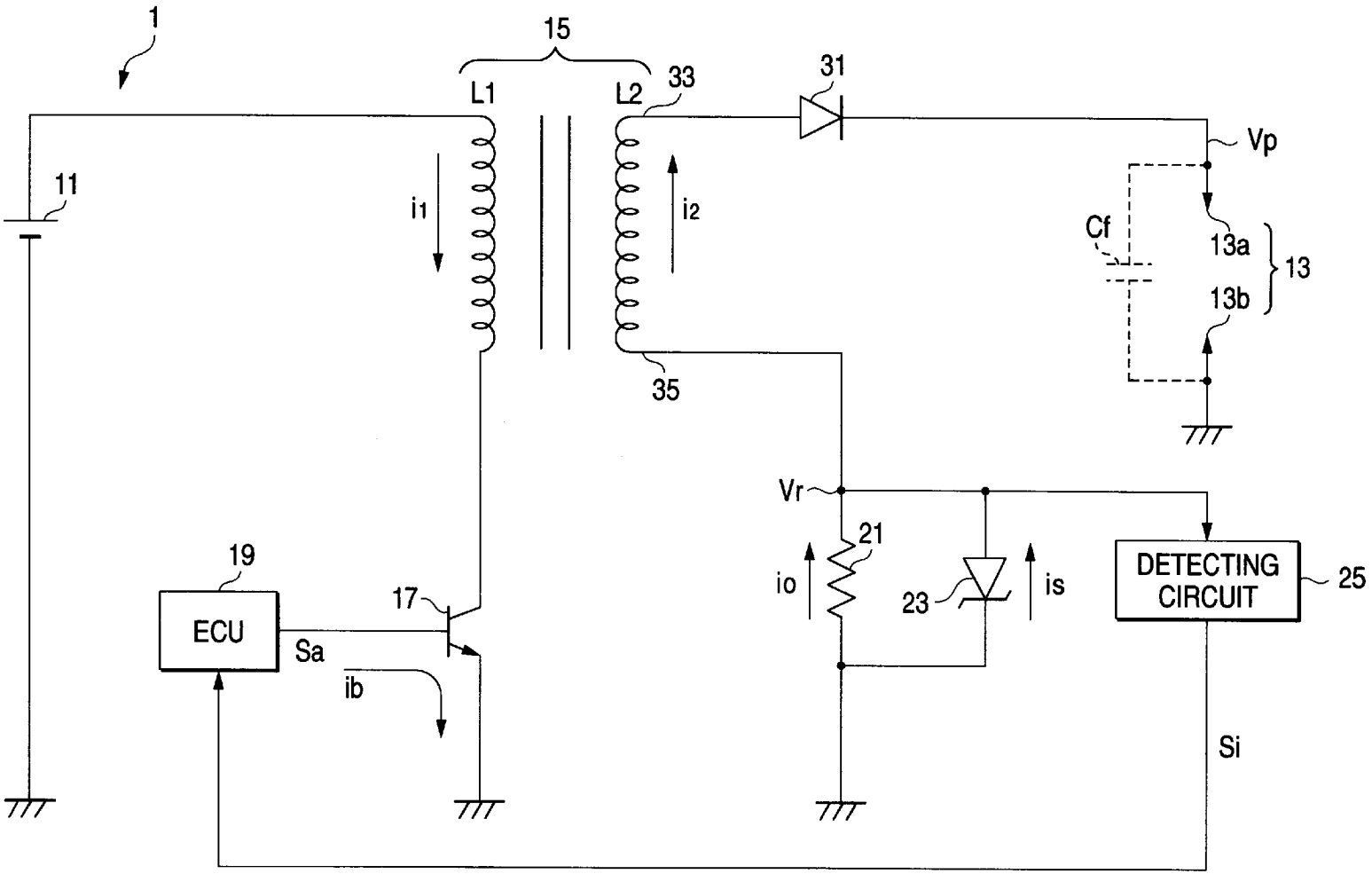
FIG. 1 is an electric circuit diagram showing the structure of the ignition apparatus for internal combustion engine of the embodiment.

FIG. 1 is an electric circuit diagram showing the structure of the ignition apparatus for internal combustion engine having an embodied ionized current detecting unit.

In the present embodiment, explanation will be made to a 1 cylinder, but the invention may be applied to internal combustion engines having a plurality of cylinders, and basic structures of the ignition apparatus for internal combustion engines of respective cylinders are similar.

As shown in FIG. 1, the ignition apparatus for internal combustion engine 1 of the present embodiment has a power supply (battery) 11 providing a constant voltage (e.g., voltage 12 [V]), a spark plug 13 provided in the cylinder of the internal combustion engine, the ignition coil 15 having the primary winding L1 and the secondary winding L2 for a high voltage for firing, the transistor 17 including an npn type power transistor connected in series to the primary winding L1, and an electronic control unit 19 (hereafter referred to as "ECU 19") for outputting a 1st command signal Sa to drive and control the transistor 17.

Further, the ignition apparatus for internal combustion engine 1 has the diode for preventing reverse current 31 where anode is connected to the secondary winding L2 (the high-voltage side 33 of the secondary winding L2) and the cathode is connected to the center electrode 13*a* of the spark plug 13,

- the detecting resistor 21 connected between the low voltage side 35 of the secondary winding L2 and the ground of the equipotential to the negative electrode of the power supply 11,
- the supplied voltage limiting Zener diode 23 connected in parallel to the detecting resistor 21, and
- the detecting circuit 25 for issuing an ionized current detecting signal Si changing in response to the ionized current on the basis of the voltage Vr at both ends of the detecting resistor 21 (the detecting current io in proportion to the ionized current x the resistance value of the detecting resistor 21).

As for the above mentioned ignition apparatus, the transistor 17 may be a switching element made of a semiconductor element switching on the basis of the 1st command signal Sa from ECU 19 for making and cutting off the conduction to the primary winding L1 of the ignition coil 15. The ignition apparatus to be provided in the internal combustion engine of this embodiment may be a full transistor type ignition apparatus.

The primary winding L1 is connected at one end to the positive electrode of the power supply 11 and at the other end to a collector of the transistor 17, while the secondary winding L2 is connected at one end (the low voltage side 35), via the detecting resistor 21, to the ground of the equipotential to the negative electrode of the power supply 11 and at the other end (the high pressure side) to the anode of the diode for preventing reverse current 31.

Further, the diode for preventing reverse current 31 is connected at the anode to the secondary winding L2 and at the cathode to the center electrode 13*a* of the spark plug 13, and the diode for preventing reverse current 31 is provided to conduct a current from the secondary winding L2 toward the center electrode 13*a* of the spark plug 13 and to cut off a conduction of a current from the center electrode 13*a* of the spark plug 13 toward the secondary winding L2.

Further, the supplied voltage limiting Zener diode 23 is connected at the anode with the connecting point between the low voltage side 35 of the secondary winding L2 and one end of the detecting resistor 21, and at the cathode with the ground of the equipotential to the negative electrode of the power supply 11. In other words, The supplied voltage limiting Zener diode is connected in parallel to the detecting resistor 21.

The connecting point between the low voltage side 35 of the secondary winding L2 and the detecting resistor 21 is connected to the input terminal of the detecting resistor 25.

The detecting circuit 25 is so structured as to output an ionized current detecting signal Si to be changed in response to the ionized current generating between the electrodes of the spark plug 13 (between the center electrode 13*a* and the earth electrode 13*b*) on the basis the voltage Vr (actually, the potential in the connecting point between the detecting resistor 21 and the secondary winding L2) at both ends of the detecting resistor 21.

The detecting circuit 25 may be made so that the changing range of the output ionized current detecting signal Si does not get out of a range enabling to input in ECU 19.

The earth electrode 13*b* opposite to the center electrode 13*a* may form a spark discharge gap producing the spark discharge therebetween, and may be earthed in the ground of the equipotential to the negative electrode of the power supply 11.

The transistor 11 is connected at a base to the output terminal of the 1st command signal Sa of ECU 19 and is earthed at an emitter in the ground of the equipotential to the negative electrode of the power supply 11.

In case the 1st command signal Sa output from ECU 19 is at low level (the ground potential); a base current ib does not flow; the transistor 17 is OFF (which is corresponding to the state of cutting off a conduction), whereby the current (the primary current i1) never flows in the primary winding L1 by the transistor 17.

In contrast, in case the 1st command signals Sa output from ECU 19 is at high level (the supplied current 5[V] from the constant voltage power supply); the base current flows; the transistor 17 is ON (which is corresponding to the state of the conductive), whereby the current (the primary current i1) flows in the primary winding L1 by the transistor 17.

Therefore, under the condition that the 1st command signal Sa is at the high level and the primary current i1 flows in the primary winding, when the 1st command signal Sa is at low level, the transistor 17 is OFF, whereby the conduction of the primary current i1 to the primary winding is cut off (stopped).

Then, the magnetic flux density rapidly changes, and the high voltage for firing is generated in the secondary winding L2. If the high voltage for firing is supplied to the spark plug 13, the spark discharge generates between the electrodes 13*a*–13*b* of the spark plug 13.

The ignition coil 15 is provided so as to generate a higher voltage for firing (which has the positive polarity) than the ground potential in the center electrode 13*a* of the spark plug 13 in the secondary winding L2 by cutting off the conduction to the primary winding L1, whereby the spark discharge is generated between the electrodes 13*a*–13*b* of the spark plug 13.

Being accompanied with the spark discharge, the secondary current i2 (the spark discharge current i2) is flowing in the secondary winding L2, the secondary current is flowing back to the secondary winding L2 through the diode for preventing reverse current 31, the center electrode 13*a* of the spark plug 13, the earth electrode 13*b*, the ground, the detecting resistor 21 and the supplied voltage limiting Zener diode 23 in order.

When the spark plug 13 is generated by the high voltage for firing, since the voltage supplied to the supplied voltage limiting Zener diode 23 is higher than a Zener voltage, the discharged current flows in the supplied voltage limiting Zener diode 23. That is, the supplied voltage limiting Zener diode restrains the voltage at both ends of the detecting resistor 21 from exceedingly heightening.

Following the continuation of the spark discharge in the spark plug 13, the energy accumulated in the ignition coil 15 is consumed. If this energy is lower than the amount necessary for continuing the spark discharge, the spark discharge naturally ceases in the spark plug 13.

At the time when the spark discharge naturally ceases in the spark plug 13, the residual energy remains in the ignition coil 15, and the voltage of around several kV is generated at both ends of the secondary winding L2, though it is insufficient to generation of the spark discharge.

Therefore, after the spark discharge naturally ceases in the spark plug 13, the induced voltage, (the ionized current generating voltage) generated at both ends of the secondary winding L2 by the residual energy is supplied to the series circuit of the diode for preventing reverse current 31, spark plug 13, ground, and the detecting resistor 21 (the supplied voltage limiting Zener diode 23).

To explain in more detail, the induced voltage generated at both ends of the secondary winding L2 by the residual energy after ending the spark discharge in the spark plug 13 is supplied in the spark plug 13 so that the induced voltage is charged in the floating capacitor existing in the conductive path of the secondary current including the floating capacitor Cf of the spark plug 13. By using this supplied charge, the ionized current is generated between the electrodes 13*a*–13*b* of the spark plug 13.

In the case where the ion exists between the electrodes 13*a*–13*b* of the spark plug 13, the ionized current is generated between the electrodes 13*a*–13*b* of the spark plug 13 by the ionized current generating voltage, which is generated at both ends of the secondary winding L2 by the residual energy (in detail, by the charge supplied in the floating capacitor existing in the conductive path of the secondary current including the floating capacitor Cf of the spark plug 13 in company with supplying the ionized current generating voltage to the spark plug).

When the ionized current is generated in such a way, the detecting current io in proportion to the ionized current flows in the path from the secondary winding L2 of the ignition coil 15, via the diode for preventing reverse current 31, spark plug 13, ground, and the detecting resistor 21, to the secondary winding L2.

Herein, the induced voltage generated at both ends of the secondary winding L2 after ending the spark discharge in the spark plug 13 is charged in the floating capacitor existing in the conductive path of the secondary current, but the electric charge supplied in the floating capacitor Cf of the spark plug 13 is prevented from back-flow to the secondary winding L2 by the diode for preventing reverse current 31 connected in the conductive path connecting the high voltage side 33 of the secondary winding L2 and the spark plug 13.

Thus, the electric charge supplied in the floating capacitor Cf of the spark plug 13 by the induced voltage generated at both ends of the secondary winding L2 by the residual energy is effectively used for generating the ionized current between the electrodes of the spark plug 13 through a combination with the diode for preventing reverse current 31, which is allow to make only the conduction of the current directing to the center electrode 13*a* of the spark plug 13 from the secondary winding L2.

When the ionized current is generated between the electrodes of the spark plug 13 in case that the voltage Vr at both ends of the detecting resistor 21 (the supplied voltage to the supplied voltage limiting Zener diode 23) is down the breakdown voltage (Zener voltage) of the supplied voltage limiting Zener diode 23, the current does not flow in the supplied voltage limiting Zener diode 23.

In such a case, the detecting current io in proportion to the ionized current flows from the secondary winding L2 through the diode for preventing reverse current 31, spark plug 13, ground and detecting resistor 21.

As the supplied voltage limiting Zener diode 23, such a Zener diode is used where the breakdown voltage is determined to be higher than the voltage at both ends of the detecting resistor 21 when producing the ionized current generating voltage by the residual energy of at least ignition coil 15 (when producing the ionized current). Therefore, when producing the ionized current generating voltage by the residual energy of the spark plug 15, the current does not flow in the supplied voltage limiting Zener diode 23 but the detecting current io flows through the detecting resistor 21.

When the ionized current is generated between the electrodes 13*a*–13*b* of the spark plug 13, the voltage in proportion to the magnitude of the detecting current io is generated at both ends of the detecting resistor 21, and the voltage Vr at both ends of the detecting resistor 21 changes in proportion to the magnitude of the detecting current io (the ionized current).

When the voltage Vr at both ends of the detecting resistor 21 changes, the detecting circuit 25 outputs the ionized current detecting signal Si to ECU 19 on the basis of the detected voltage Vr at both ends of the detecting resistor 21. The detecting circuit 25 shows the same change as that of the voltage Vr at both ends of the detecting resistor 21 within the range in response. to the input range of the inputting terminal of ECU 19, and outputs, as the ionized current detecting signal Si, a signal whose positive and negative polarities are reversed with respect to the potential of the connecting point of the detecting resistor 21 and the secondary winding L2. Thus, the detecting circuit 25 outputs the ionized current detecting signal Si changing in response to the ionized current to the ECU 19.

Figure 2:
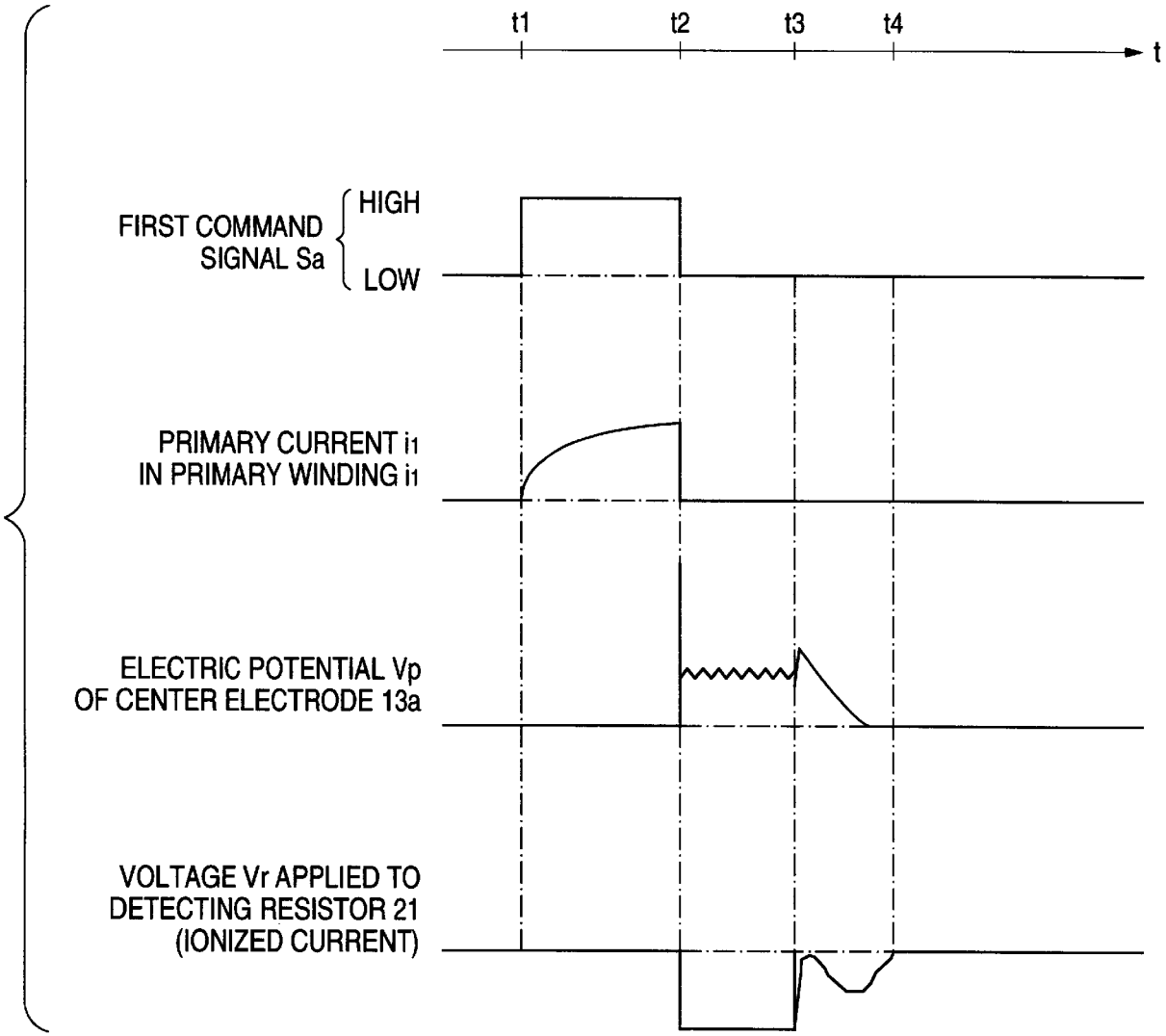
FIG. 2 is a time chart showing conditions in the respective parts in the ignition apparatus for internal combustion engine when the ignition is normally made to the air-fuel mixture.

FIG. 2 shows time charts, when the ignition to the air-fuel mixture is normally made, expressing respective conditions of the 1st command signal Sa, primary current i1 flowing in the primary winding L1, potential Vp of the center electrode 13*a* of the spark plug 13, and voltage Vr at both ends of the detecting resistor 21 (in other words, the ionized current) in the circuit diagram shown in FIG. 1.

As shown in FIG. 2, when then 1st command signal Sa is switched from the low level to the high level at the time t1, the current (the primary current i1) starts to flow in the primary winding L1 of the ignition coil 15. Then, the voltage is generated at both ends of the secondary winding L2 by change of the magnetic flux density in company with the conduction starting of the primary current i1, and the voltage is generated at this time such that the center electrode 13*a* of the spark plug 13 becomes negative potential. Herein, the current generated by the voltage generated at both ends of the secondary winding L2 when starting the conduction of the primary current i1, is checked from the conduction by the diode for preventing reverse current 31, and the potential Vp of the center electrode 13*a* of the spark plug 13 does not change and the spark discharge is not generated between the electrodes 13*a*–13*b* of the spark plug 13.

When the 1st command signal Sa is switched from the high level to the low level at the time t2 when the conductive time (the primary current conductive time) passes which has previously been determined to adapt to any operating conditions of the internal combustion engine from the time t1, the conduction of the primary current i1 to the primary winding L1 of the ignition coil 15 is cut off, the magnetic flux density rapidly changes, and the high voltage for firing (several+[kV] or more) is generated at the secondary winding L2 of the ignition coil 15. Then, the high voltage for firing of the positive polarity is supplied to the center electrode 13*a* of the spark plug 13 from the high voltage side 33 of the secondary winding L2, the potential Vp of the center electrode 13*a* rapidly heightens, the spark discharge is generated between the electrodes 13*a*–13*b* of the spark plug 13, and the secondary current i2 flows in the secondary winding L2.

As the higher voltage than the Zener voltage is supplied at both ends of the supplied voltage limiting Zener diode 23, the supplied voltage limiting Zener diode 23 makes a Zener breakdown and the current flows.

That is, the secondary current i2 (the discharged current is) generated by the high voltage for firing flows through the diode for preventing reverse current 31, spark plug 13, ground, detecting resistor 21 and supplied voltage limiting Zener diode 23. Therefore, the voltage Vr at both ends of the detecting resistor 21 when generating the spark discharge is maintained at the Zener voltage of the supplied voltage limiting Zener diode 23, and during the period from the time t2 to the time t3 in FIG. 2, the voltage Vr at both ends of the detecting resistor 21 shows the constant value (the Zener voltage)

Thereafter, from the time t2 to the time t3, the magnetic flux energy of the ignition coil 15 is consumed in company with continuation of the spark discharge in the spark plug 13, and when the voltage generated at both ends of the secondary winding L2 becomes smaller than a voltage necessary for the spark discharge by the magnetic flux energy of the ignition coil 15, the spark discharge cannot go on and naturally ceases. However, as the residual energy exist in the ignition coil 15 even after the spark discharge in the spark plug 13 naturally ceases, the induced voltage is generated continuously at both ends of the secondary winding L2.

After the spark discharge naturally ceases, the induced voltage generated at both ends of the secondary winding L2 by the residual energy is supplied as the ionized current generating voltage in the series circuit of the diode for preventing reverse current 31, spark plug 13, ground and detecting resistor 21 (the supplied voltage limiting Zener diode 23) when the ion exists between the electrodes 13*a*–13*b* of the spark plug 13, the ionized current is generated between the electrodes 13*a*–13*b*.

As a lower voltage than the Zener voltage is supplied at both ends of the supplied voltage limiting Zener diode 23, the current does not flow in the supplied voltage limiting Zener diode 23. Therefore, the ionized current, which is generated by the induced voltage (the ionized current generating voltage) generated the residual energy, flows through the diode for preventing reverse current 31, spark, plug 13, ground and detecting resistor 21.

As the ion generated by ionization brings out with combustion of the air-fuel mixture (fuel), ion generates at the normal combustion, but does not generate at the misfire.

When the ionized current is generated immediately after the time t3 of FIG. 2, the detecting current io in proportion to the ionized current flows in the path from the secondary winding L2, through the diode for preventing reverse current 31, spark plug 13, ground and detecting resistor 21, till the secondary winding L2.

By flowing the detecting current io, potential difference generates at both ends of the detecting, resistor 21, and the voltage Vr at both ends of the detecting resistor 21 changes in response to the magnitude of the ionized current.

The waveform, which shows a change of the ionized current at this period (the voltage Vr at both ends of the detecting resistor 21) from the time t3 to the time t4 in FIG. 2, is formed a like-mountain in shape.

The ionized current shown in FIG. 2 shows the waveform at the normal combustion, and it is seen that the ionized current is generated in proportion to the amount of generating the ion during the period from the time t3 to the time t4.

Further, the detecting position of the voltage at both ends of the detecting resistor 21 is the connecting point between the detecting resistor 21 and the secondary winding L2, and the potential at this connecting point is lower by the voltage Vr at both ends of the detecting resistor 21 than the ground potential (0[V]). Therefore, the nearer to a negative value the ionized current waveform (the nearer to the lower position in FIG. 2) is in FIG. 2, the larger the flowing amount of the ionized current is.

Figure 3:
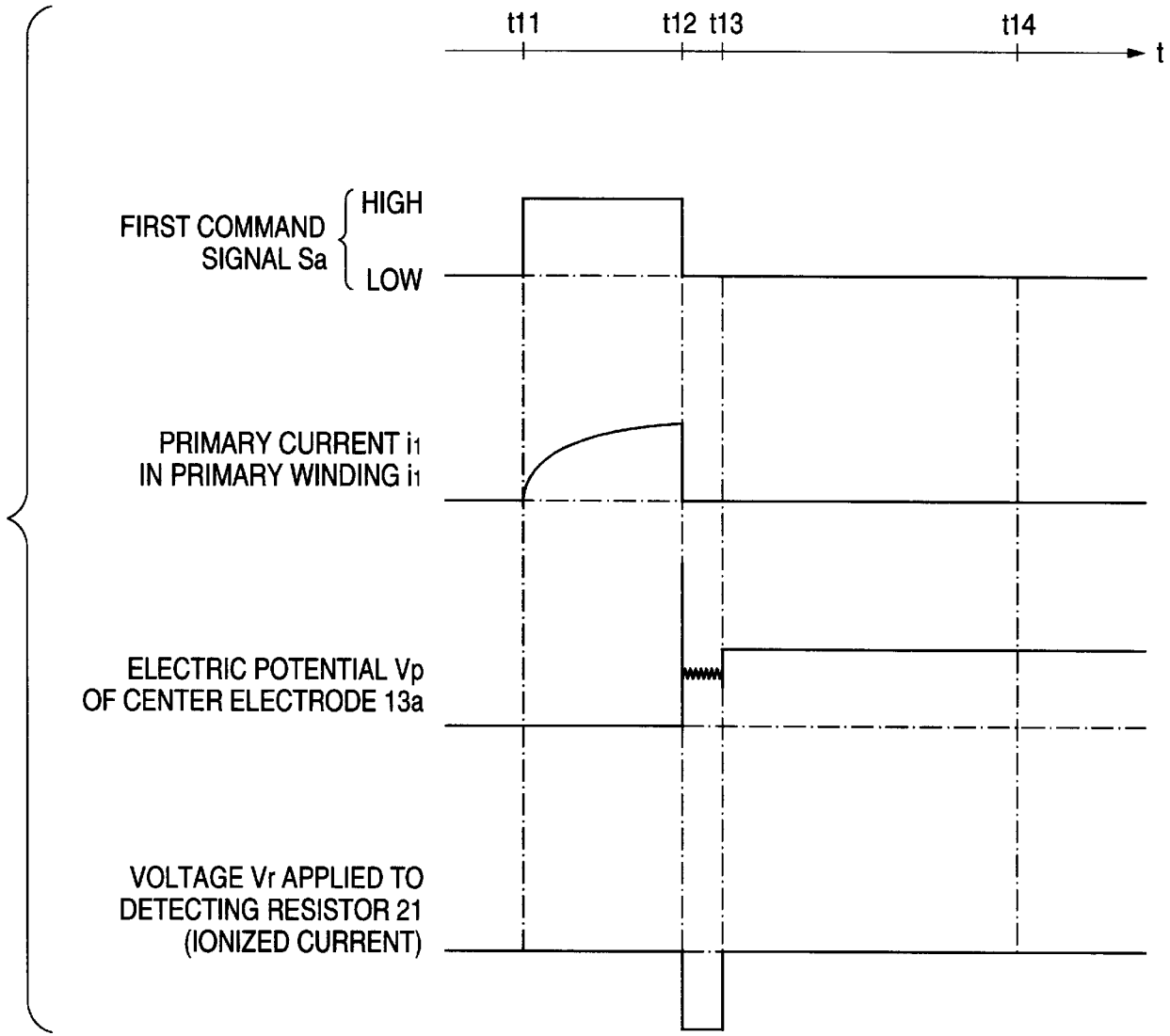
FIG. 3 is a time chart showing conditions in the respective parts in the ignition apparatus for internal combustion engine in case of the misfire when the ignition is not normally made to the air-fuel mixture.

FIG. 3 is a time chart showing respective conditions of the 1st command signal Sa, primary current i1 flowing in the primary winding, potential Vp of the center electrode 13*a* of the spark plug 13, and voltage Vr at both ends of the detecting resistor 21 (in other words, the ionized current) in the circuit diagram shown in FIG. 1 in case that the misfire generates without the normal ignition of the air-fuel mixture.

The conditions of the respective parts from the time t11 to the time t13 show almost the same changes as those from, the time t1 to the time t2 of FIG. 2. But, during the period from the time t12 to the time t13, although the spark discharge is generated between the center electrode 13*a* and the earth electrode 13*b* of the spark plug 13, this conditions during the period from the time t12 to the time t13 is a misfire state of the air-fuel mixture without igniting the air-fuel mixture.

The waveforms shown in FIG. 3 are assumed as the misfire condition at the high speed rotation. Therefore, the spark discharge ends at an early period owing to turbulent flow of the air-fuel mixture and the continuing time of the spark discharge is shorter than that at the normal combustion. Further, the spark discharge ends at the time t13, as the same case of FIG. 2, the induced voltage (the ionized current generating voltage) generated at both ends of the secondary winding L2 by the residual energy of the ignition coil 15 is supplied to the spark plug 13.

However, since the air-fuel mixture is a misfire state without igniting, in a cylinder ion does not exist. Therefore, the ionized current does not flow between the electrodes 13*a*–13*b* of the spark plug 13.

Further, at the time t13 and thereafter, as seen in FIG. 3, the voltage Vr (the ionized current waveforms) at both ends of the detecting resistor 21 is not substantially changed.

When the voltage Vr (the ionized current) at both ends of the detecting resistor 21 is changed by the ionized current generating voltage generated by the residual energy of the ignition coil 15, it may be judged as a state of the normal combustion, and when the voltage Vr (the ionized current) at both ends of the detecting resistor 21 is not changed, it is judged as a state of the misfiring.

At the time t13 and thereafter, the induced voltage generated at both ends of the secondary winding by the residual energy existing in the ignition coil is charged in the floating capacitor Cf of the spark plug 13. But the supplied charge in the floating capacitor Cf of the spark plug 13 is not consumed but maintained at the amount of the constant charge, since the ion does not exist between the electrodes 13*a*–13*b* of the spark plug 13 by causing the misfiring, and the diode for preventing reverse current 31 is provided in the conductive path between the high voltage side 33 of the secondary winding L2 and the spark plug 13.

Thus, the potential Vp of the center electrode 13*a* of the spark plug 13 at the time t13 and thereafter shows the almost constant waveforms.

At the time t13 and thereafter of the misfiring, the voltage supplied in the floating capacitor Cf of the spark plug 13 is consumed by the spark discharge during periods outside of the ranges shown in FIG. 3.

In short, since there is a relationship that the lower the pressure in the cylinder is, the lower the discharged voltage in the spark plug 13 is, if the volume within the cylinder is increased to reduce the pressure by the piston actuating during the process between the time t13 and thereafter of the misfiring and the time prior to firing, the spark discharge is generated between the electrodes of the spark plug 13 by the voltage charged in the floating capacitor Cf.

By the way, the spark discharge is generated at a time before shifting a subsequent combustion cycle (a combustion cycle means to perform the air-inlet, compression, combustion and air exhaust).

Therefore, in the present embodiments such an object is always accomplished of checking the misfiring by the spark discharge at the spark plug 13 when starting the conduction to the primary winding, and thus the subject matter of the invention is not influenced.

Incidentally, when the internal combustion engine is operated at high speed, the spark discharge ends at the early period because the turbulent flow of the air-fuel mixture in the combustion chamber is strong, and the residual energy existing in the ignition coil becomes large. In case the misfiring is generated when the internal combustion engine is operated at high speed, since the residual energy existing in the ignition coil is large, the induced voltage generated by the residual energy is large in comparison with the low speed operation. Therefore, at the high speed operation, the spark discharge may be probably re-generated between the electrodes 13*a*–13*b* of the spark plug 13 owing to the voltage induced by the residual energy.

Figure 4:
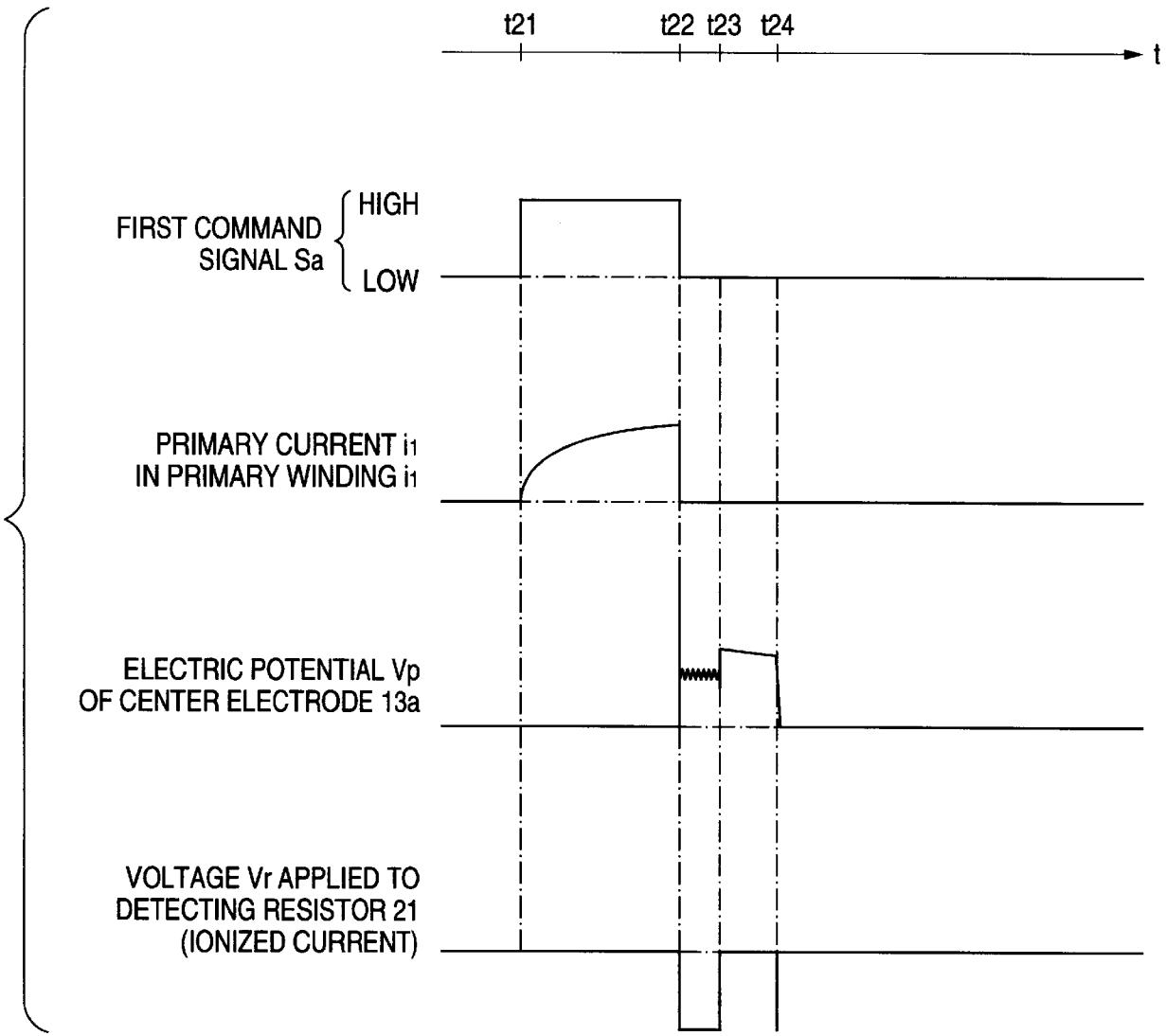
FIG. 4 is a time chart showing conditions in the respective parts in the ignition apparatus for internal. combustion engine when the spark discharge is re-generated after the misfire.

FIG. 4 is a time chart showing respective conditions of the 1st command signal Sa, primary current i1 flowing in the primary winding, potential Vp of the center electrode 13*a* of the spark plug 13, and voltage Vr at both ends of the detecting resistor 21 (in other words, the ionized current) in the circuit diagram in FIG. 1, when the spark discharge is re-generated by the spark plug 13 after the misfiring.

The time t21 to the time t23 of FIG. 4 show the same waveforms from the time t11 to the time t13 when misfiring as shown in FIG. 3.

At the time t24 after passing the time t23, the induced voltage, which is generated by the residual energy existing in the ignition coil 15, destroys insulation between the electrodes 13*a*–13*b* of the spark plug 13, whereby the re-generation of the spark discharge occurs. Therefore, potential Vp of the center electrode 13*a* is down almost the equipotential to the ground potential.

The voltage Vr at both ends of the detecting resistor 21 changes and instantaneously shows a large value, but the residual energy in the ignition coil is consumed by the re-generation of the spark discharge and thereafter, the voltage Vr at both ends of the detecting resistor 21 does not change.

Therefore, after the ignition to the air-fuel mixture is not made and even when the spark discharge is re-generated by the residual energy existing in the ignition coil, the waveform of the voltage Vr at both ends of the detecting resistor 21, (that is, the waveform of the ionized current detecting signal Si) is almost the same as that at the time when misfiring, and accordingly it can be judged as misfiring. Thus, even when the spark discharge is re-generated, the precision of detecting the misfiring may not be reduced.

Further explanation will be made to an ionized current detecting process to be exerted in ECU 19 of the ignition apparatus for internal combustion engine 1, referring to the flow chart shown in FIG. 5.

ECU 19 is for synthetically controlling the spark discharge generating period (the ignition period) of the internal combustion engine, the fuel jetting amount, and the idle rotation number, and other than the ionized current detecting process which will be explained as follows, ECU independently exerts the processes of detecting operating conditions of the respective engine parts such as the amount of intake air (the pressure in the air inlet pipe), the rotating speed (the engine rotation number), throttle angle, cooling water temperature, and intake charge mixture temperature.

Figure 5:
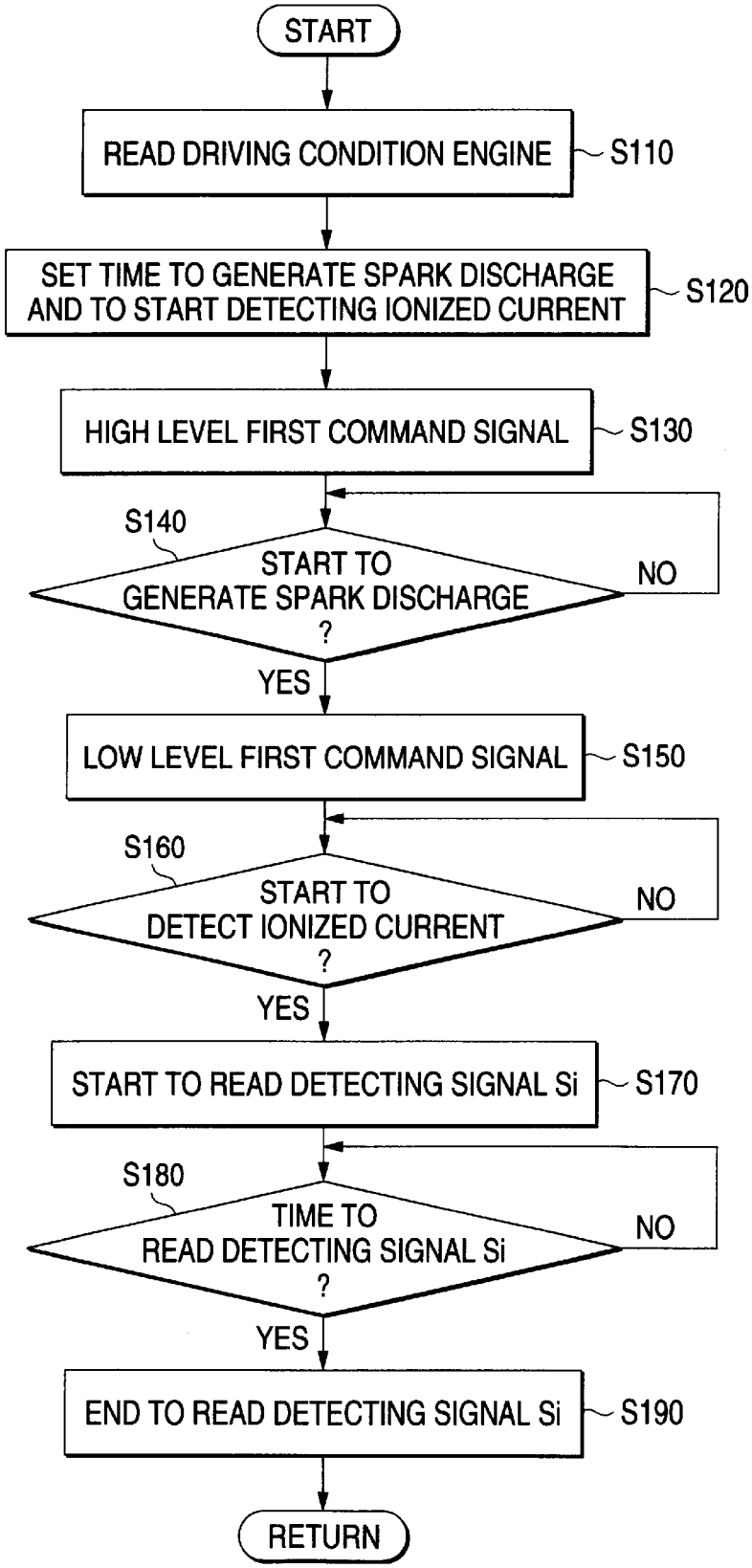
FIG. 5 is a flow chart showing the processing contents of the ionized current detecting process performed in the electronic control unit (ECU) of the ignition apparatus for internal combustion engines.

The ionized current detecting process shown in FIG. 5 is exerted once per 1 combustion cycle of the internal combustion engine performing the air-inlet, compression, combustion and air-exhaust on the basis of, for example, the signal from the crank angle sensor detecting the rotation angle (the crank angle) of the internal combustion engine, and is further exerted together with the ignition controlling process.

When the internal combustion engine starts the ionized current detecting process, at first S110 ("S" shows a step) reads the driving condition of the internal combustion engine detected by the driving condition detecting process exerted separatelys and S120 determines the spark discharge generating period (so-called ignition period) ts and the ionized current detection starting period ti on the basis of the read driving conditions.

In the processor S110, it is preferable to read, as operating conditions, information including the rotation number of the internal combustion engine, and an engine load calculated by use of the throttle angle and the negative pressure of the air inlet pipe (the amount of intake air).

In the process of S120, the spark discharge generating period ts is determined through the conventional procedure demanding a controlling standard value by using a map or a calculating formula having parameters of the engine rotation number and the engine load, and correcting the controlling standard value on the basis of cooling water temperature and intake charge mixture temperature.

In order that a period ti starting detection of the ionized current is set at a time when the spark discharge naturally ceases, the period ti is determined by use of the previously prepared map or calculating formula on the basis of the operating conditions including the engine rotation number and the engine load. The map or the calculating formula to be used at this time are so structured that the period ti is set at a late period under the operating condition of moderate combustion of the air-fuel mixture (the low rotation and the low load), while the period ti is set at an early period under the operating condition of rapid combustion of the air-fuel mixture (the high rotation and the high load). In the embodiment, the optimum period ti starting detection of the ionized current is set by using the map, which has the parameters of the engine rotation number and the engine load.

In the process of S130, finding a conduction starting period of the primary winding L1 on the base of the spark discharge generating period ts set at S120, and the conduction starting period of the primary winding L1 sets up early by the predetermined conductive time of the primary winding L1 with respect to the spark discharge generating period ts.

If the conduction starting period (the time t1 shown in FIG. 2) is coming, the 1st command signal Sa is changed from the low level to the high level.

When the 1st command signal Sa is switched from the low level to the high level by the process of S130, the transistor 17 is ON, so that the primary current i1 flows in the primary winding L1 of the ignition coil 15.

The conductive time of the primary winding L1 till the spark discharge generating period ts is in advance determined such that the energy accumulated in the ignition coil 15 by the conduction to the primary winding L1 becomes a maximum sparking energy enabling to burn the air-fuel mixture under every operating condition of the internal combustion engine.

A subsequent S140, being based on the detecting signal from the crank angle sensor, judges whether the process comes to the spark discharge generating period ts set at S120 or not. If not, this step is repeatedly exerted until the process comes to the spark discharge generating period ts when it is judged at S140 that the process comes to the spark discharge generating period ts (the time t2 shown in FIG. 2), the process moves to S150.

Then, S150 changes the 1st command signal Sa from the high level to the low level, and as a result, the transistor 17 turns off to cut off the primary current i1, whereby the magnetic flux density of the ignition coil 15 rapidly changes. Therefore, the high voltage for firing generates in the secondary winding L2 and the spark discharge is generated between the electrode 13*a*–13*b* of the spark plug 13.

A following S160 judges if the process comes to a period ti of starting detection of the ionized current set at S120. If not, this step is repeatedly exerted until the process comes to the period ti of starting detection of the ionized current.

When it is judged at S160 that the process comes to the period ti of starting detection of the ionized current (the time t3 shown in FIG. 2), the process moves to S170. S170 starts the reading of the ionized current detecting signal Si.

Herein, the period ti of starting detection of the ionized current is set at a period when the spark discharge naturally ceases in the process at S120, and when the process comes to S170, the spark discharge naturally ceases and the induced voltage is generated at both ends of the secondary winding L2 by the residual energy existing in the ignition coil 15. This induced voltage is supplied as the ionized current generating voltage between the electrode 13*a*–13*b* of the spark plug 13.

At a time when the ionized current generating voltage caused by the residual energy in the ignition coil 15 is supplied between the electrode 13*a*–13*b* of the spark plug 13, if an ion exists between the electrodes 13*a*–13*b*, the detected current io in proportion to the ionized current is generated by the electric charge supplied to the floating capacitor existing in the conductive path of the secondary current including the floating capacitor of the plug 13 by the ionized current generating voltage.

Thus, the potential of the connecting point between the detecting resistor 21 and the secondary winding L2 is changed in response to the voltage Vr at both ends of the detecting resistor 21. After starting a process of S170, ECU 19 continuously performs in the interior thereof a reading process of the ionized current detecting signal Si output from the detecting circuit 25 in response to changing of the voltage Vr at both ends of the detecting resistor 21.

Subsequently, at S180, after S160 judges Yes, it is judged if the process passes the time of reading the detecting signal previously set in ECU 19 as the time for reading the ionized current detecting signal Si. If judging No, the process waits for by repeatedly exerting this step.

At S180, when judging that the process passes the time of reading the detecting signal (the time t4 shown in FIG. 2 and the time t14 in FIG. 3), the process moves to S190. In this embodiment, the time of reading the detecting signal may be a fixed value determined in advance, irrespective of the operating conditions of the internal combustion engine, and may have an appropriate value coping with the operating conditions.

S190 stops the reading process of the ionized current detecting signal Si started in S170. When the process at S190 ends, the present ionized current detecting process ends.

ECU19 independently exerts a non-fire judging process for judging presence or absence of the misfiring in the internal combustion engine on the basis of the detecting current io in proportion to the ionized current generated between the electrodes 13*a*–13*b* of the spark plug 13. Namely, this non-fire judging process carries out the judgement of the misfiring during the period between the time t3 and the time t4 in FIG. 2 on the basis of the ionized current detecting signal Si issued from the detecting circuit 25.

The misfiring judging process compares a peak value of the ionized current detecting signal Si except a peak value immediately after the time t3 with a judging standard value determined in advance for judging the misfiring, and judges a case of peak values below the judging standard value as the misfiring. Another misfiring judging process calculates an integral value of the ionized current detecting signal Si except the peak value immediately after the time t3 during the period from the time t3 to the time t4, compares this integral value with the judging standard value determined in advance for judging the misfiring, and may judge a case of the integral value below the judging standard value as the misfiring. By the way, the respective judging standard values used for judging the misfiring are not limited to fixed values determined in advance, but may determine values by use of a map or a calculating formula having parameters of the engine rotation number and the engine load on the basis of the operating conditions of the internal combustion engine (for example, information including the engine rotation number and load).

As mentioned above, in the ignition apparatus 1 for internal combustion engine of the embodiment, the diode for preventing reverse current 31 is provided between the secondary winding L2 of the ignition coil 15 being the conductive path of the secondary current i2 and the center electrode 13*a* of the spark plug 13, thereby to limit the current flowing direction in the conductive path of the secondary current i2 to be one direction.

The diode for preventing reverse current 31 cuts off the conduction of the secondary current i2 by high voltage occurring at both ends of the secondary winding L2 when starting conduction to the primary winding L1.

Therefore, when starting conduction to the primary winding, the spark discharge does not occur between the electrodes (between the center electrode 13*a* and the earth electrode 13*b*) of the spark plug 13.

In the present ignition apparatus for internal combustion engine, by supplying the induced voltage (the ionized current generating voltage) generated by the residual energy in the ignition coil 15 after ending the spark discharge, the ionized current is generated between the electrodes 13*a*–13*b* of the spark plug 13. That is, the ignition coil 15 (the secondary winding L2) serves as the power supply producing the high voltage for firing for causing the spark discharge between the electrodes of the spark plug 13 and also serves as the current source producing the ionized current between the electrodes of the spark plug 13.

Herein, the residual energy existing in the ignition coil when ending the spark discharge of the spark plug, is insufficient for continuing the spark discharge, but has the sufficient amount for generating the ionized current by charging the floating capacitor in the conductive path of the secondary current. That is, the voltage for generating the ionized current at both ends of the secondary winding by the residual energy after ending the spark discharge is around 1 to 5 [kV].

Such a voltage for generating the ionized current at both ends of the secondary winding is higher than a voltage, which is 100 to 300 [V] in the related art, accumulated by a capacitor for generating an ionized, current, which is supplied between electrodes of the spark plug. Therefore, a larger ionized current than the one in the related art flows between the electrodes of the spark plug, so that a detection accuracy of the ionized current may be improved.

The detecting resistor 21 forms the closed loop together with the spark plug 13 and the secondary winding L2 of the ignition coil 15 when supplying the ionized current generating voltage between the electrodes of the spark plug 13, and can detect the detecting current io in proportion to the ionized current generated between the electrode of the spark plug 13.

ECU 19 calculates the voltage at both ends of the detecting resistor 21 based on the ionized current detecting signal Si and divides the calculated voltage with the resistance value of the detecting resistor 21 for calculating the current value of the ionized current.

In the ignition apparatus 1 for internal combustion engine of this embodiment, the spark plug 13 and the ignition coil 15 (the secondary winding L2) are connected such that when breaking the conductIon of the primary current i1, the high voltage for firing is supplied where the center electrode 13*a* of the spark plug 13 is positive potential. Therefore, the induced voltage generated by the residual energy of the ignition coil 15 is supplied between the electrodes 13*a*–13*b* where the center electrode 13*a* of the spark plug 13 is positive potential, so that the detecting precision of the ionized current can be more heightened.

Figure 6A:
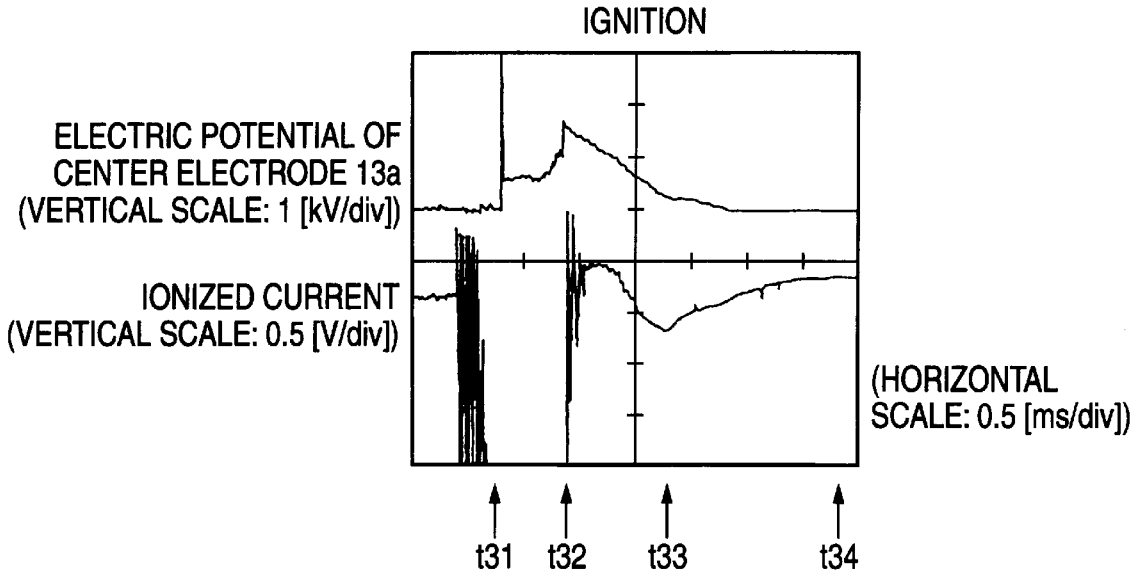
FIG. 6A is a measured result of detecting the ionized current at the normal combustion in the ignition apparatus for internal combustion engine of the embodiment.
Figure 6B:
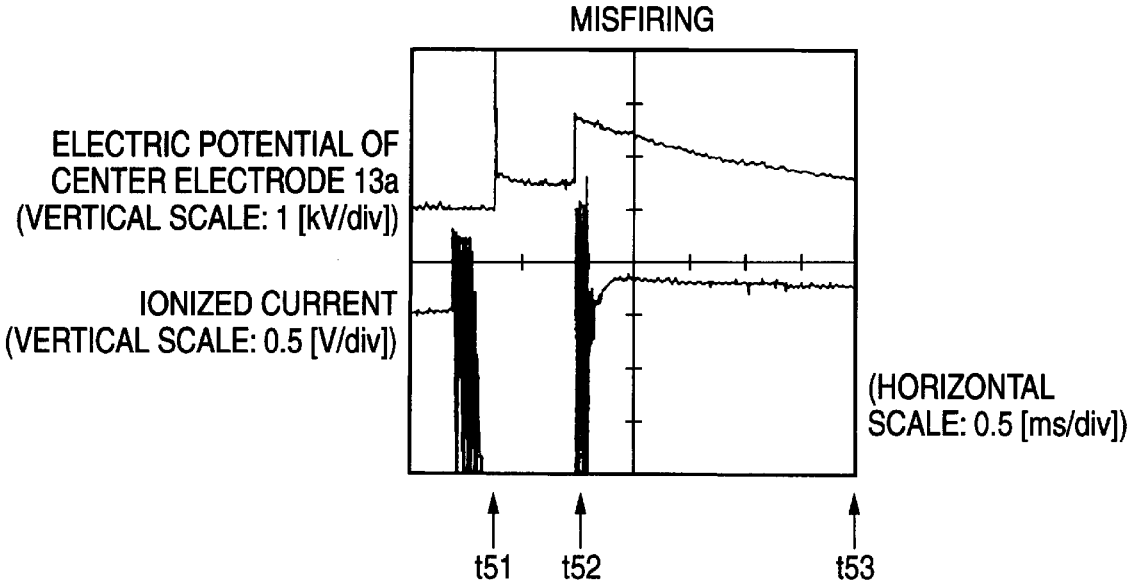
FIG. 6B is a measured result of detecting the ionized current at the misfire in the ignition apparatus for internal combustion engine of the embodiment.

Herein, FIG. 6 shows the measured results of the ionized current respectively measured at the normal combustion and at the misfiring by use of the embodied ignition apparatus for internal combustion engine FIG. 6A is the measured results at the normal combustion (ignition), while FIG. 6B is the measured results at the misfiring.

For measuring, a gas engine is used, and the procedures are performed by adjusting the air/fuel ratio for detecting the ionized current in the respective cases of setting the operating condition to be the normal combustion and setting the operating condition to be misfiring.

As to measuring at the misfiring, the misfiring condition was made by trial by not supplying the fuel for measuring. In measuring, the detecting resistor is a resistance element having a resistance value of 100 [kΩ].

As to the measured results shown in FIG. 6A, the time t31 is the spark discharge generating period (the ignition period) and the time t32 is the ending period of the spark discharge. The waveform of the ionized current shows a large change before about 0.5 [mS] of the time t31 until the time t32, and this is created by the discharged current flowing by the spark discharge and not by the ionized current. The waveform of the ionized current shows the peak value (about 0.7 [V]) at the time t33 after about 1.1 [mS] passes from the time t32. After the peak value, the current value gradually decreases, and at the time t34, the ionized current does not flow.

Next, as to the measured results shown in FIG. 6B, the time t51 is at the spark discharge generating period (the ignition period) and the time t52 is at the ending period of the spark discharge. The waveform of the ionized current shows a large change before about 0.5 [mS] of the time t51 and after about 0.2 [mS] of the time t52, and this change is created by the discharged current caused to flow by the spark discharge and not by the ionized current. It is shown that the waveform of the ionized current shows almost constant value after about 0.2 [mS] of the time t52, and the ionized current does not flow (showing about 0.2 [V]at the detecting period of the ionized current).

As to the potential of the center electrode of the spark plug, a potential of the time t53 passing about 3.0 [mS] from the time t52 is a higher potential than the potential before the time t51, and it is shown that the residual energy still remains in the ignition coil. This is attributed to that the supplied charge in the floating capacitor of the spark plug charged from the residual energy of the ignition coil is not consumed for detecting the ionized current since the diode for preventing reverse current is provided, and the ion does not occur between the electrodes of the spark plug.

Comparing the time of the normal combustion (FIG. 6A) and the time of the misfiring (FIG. 8) in the measured results, it is seen that the waveforms of the ionized current after passing the periods of ending the spark discharge (the time t32 and the time t52) are respectively different. That is, at the normal combustion (FIG. 6A) the waveform of the ionized current is formed like a mountain in shape having the peak value at the time t33 after the period of ending the spark discharge, while at the misfiring (FIG. 6B), the waveform of the ionized current scarcely changes after passing the period of ending the spark discharge.

It is seen from the measured results shown in FIG. 6 that the ionized current can be detected by use of the present ignition apparatus for internal combustion engine and the misfiring can be detected from the detected results of the ionized current. The misfiring can be detected, for example, if the judging standard value for judging the misfiring is determined in advance to be at 0.4[V] for judging if the peak value of the waveform of the ionized current is above the judging standard value.

In the embodiment, the transistor 17 corresponds to the switching means set forth in the aspects of the invention, the detecting resistor 21 is the current detecting means therein, and the supplied voltage limiting Zener diode 23 is the supplied current limiting means.

Herein, the ignition apparatus for internal combustion engine of the invention is so structured as to utilize the induced voltage occurring at both ends of the secondary winding by the residual energy of the ignition coil as source of the ionized current.

Namely, this ignition apparatus for internal combustion engine accumulates the supplied electric charge in the floating capacitor existing in the conductive path of the secondary current including the floating capacitor of the spark plug by means of the induced voltage, and makes use of this accumulated supplied charge so as to produce the ionized current between the electrodes of the spark plug.

Since the magnitude of the ionized current is changed by the operating conditions of the internal combustion engine (in other words, the induced voltage caused by the residual energy of the ignition coil) or by the magnitude of the floating capacitor existing in the conductive path of the secondary current, if the induced voltage is low and the floating capacitor is small, the ionized current is small and the ionized current may not be probably detected.

Under a condition that the ionized current is assumed to be smallest (when the induced voltage is 1[kV] and the floating capacitor of the spark plug is 10[(pF]), the ignition apparatus 1 for internal combustion engine shown in FIG. 1 is employed so as to calculate by trial a voltage detected by use of the detecting resistor of the same 100[kΩ] as in the embodiment shown in FIG. 6.

Assuming that a minimum value considered as the induced voltage is 1 [kV], a minimum element of the floating Capacitor existing in the conductive path of the secondary current is only the floating capacitor of the spark plug, and a minimum value considered as the floating capacitor of the spark plug is 10[pF], these numerical values are applied to the above conditions. A time of detecting the ionized current is equivalent to the time (2[mS]) of detecting the ionized current of the embodiment shown in FIG. 6.

Herein, the charge Q accumulated in the floating capacitor is, as shown in [Formula 1], expressed with "$Q=\int Idt$" as the time integral of the current value I, and when the current value I is fixed and the conductive time is t, the charge Ω is expressed with "$Q=I\cdot t$". Further, assuming that the value of the floating capacitor of the spark plug is C and the induced voltage generated at both ends of the secondary winding by the residual energy of the ignition coil is V, the charge Q accumulated in the floating capacitor is expressed as shown in [Formula 2]

$$Q=\int Idt=I\cdot t \quad \text{[Formula 1]}$$

$$Q=CV \quad \text{[Formula 2]}$$

By using these formulae ([Formula 1] and [Formula 2]), the current I is expressed as [Formula 3].

$$I=Q/t=CV/t \quad \text{[Formula 3]}$$

If the above mentioned conditions (the induced voltage is 1[kV], the floating capacitor of the spark plug is 10[pF], and the ionized current detecting time is 2[mS] are substituted in [Formula 3], the current value I is 5.0[μA] by the current value I=(10[pF]×1[kV])/2[mS]. The voltage at both ends of the detecting resistor of 100[kΩ] is V=5.0[μA]×100[kΩ]=0.5[V]. Since the voltage at both ends of the detecting resistor is calculated herein on an assumption that the current value is fixed, the peak value in the actual ionized current waveform is assumed as a larger value than 0.5[V]. As a result, under a condition that the ionized current is assumed to be smallest, it is seen that the voltage value detected in the detecting resistor has a distinguishable difference from the current value (about 0.2[V]) of the detecting resistor at misfiring shown in FIG. 6.

Thus, in the ignition apparatus for internal combustion engine of the invention, the normal combustion or the misfiring can be judged by setting a suitable value (for example, 0.4[V]) to the judging standard value for judging the misfiring ever under a condition that the ionized current is smallest.

The embodiment of the invention has been explained, but the invention is not limited to the embodiment but may adopt various modifications.

For example, as the period ti of starting detection of the ionized current in the ionized current detecting process is determined to include the ionized current occurring period, the period ti may be determined earlier than a period when the spark discharge naturally ceases. The period of starting detection of the ionized current is not a changing period to be determined in response to the operating conditions, but may be a fixed period previously determined.

In addition, the combustion condition enabling to be detected by using the ionized current is not only the misfire but also, for example, knocking. Also for detecting the knocking, it may be judged in that the ionized current flowing between the electrodes of the spark plug is detected, and the waveform of the detected ionized current is analyzed.

What is claimed is:

1. An ignition apparatus for an internal combustion engine comprises:

an ignition coil comprising a primary winding and a secondary winding, wherein the secondary winding has high voltage side and a low voltage side, and the ignition coil generates a firing voltage supplied to the secondary winding by cutting off a primary current flowing in the primary winding;

a switching device for conducting and cutting off the primary current;

a spark plug connected in series to the secondary winding to form a closing loop, wherein a spark discharge is generated in the spark plug when a secondary current generated by the firing voltage flows in the spark plug;

a diode for preventing a reverse current, connected to a conducting path between the spark plug and the high voltage side;

a current detecting device connected in series to the secondary winding in the spark plug;

a supplied voltage limiting device holding a voltage applied to the current detecting device below a predetermined value when the firing voltage is generated.

2. The ignition apparatus for an internal combustion engine according to claim 1, wherein the diode conducts the secondary current when a primary current is cut off, the diode cuts off the secondary current when a primary current starts to flow.

3. The ignition apparatus for an internal combustion engine according to claim 1, an ionized current generating voltage is supplied to the secondary winding by a residual energy when the residual energy remains in the ignition coil after the spark discharge.

4. The ignition apparatus or an internal combustion engine according to claim 3, wherein the current detecting device detects a current in proportion to the ionized current, which is generated when the ionized current generating voltage is supplied to the spark plug.

5. The ignition apparatus for an internal combustion engine according to claim 4, wherein the current detecting device includes a detecting resistor, one end thereof is connected to the low voltage side, the other end thereof is connected to a ground, and the current detecting device detects a current in proportion to the ionized current by using a voltage applied to the detecting resistor.

6. The ignition apparatus for an internal combustion engine according to claim 5, wherein the supplied voltage limiting device includes a Zener diode connected in parallel to the detecting resistor, an anode of the Zener diode links the low voltage side and the detecting resistor.

7. An ignition apparatus for an internal combustion engine comprises:

an ignition coil comprising a primary winding and a secondary winding, wherein the secondary winding has a high voltage side and a low voltage side, and the ignition coil generates a firing voltage supplied to the secondary winding by cutting off a primary current flowing in the primary winding;

a switching device for conducting and cutting off the primary current;

a spark plug connected in series to the secondary winding to form a closing loop, wherein a spark discharge is generated in the spark plug when a secondary current generated by the firing voltage flows in the spark plug;

a diode for preventing a reverse current, connected to a conducting path between the spark plug and the high voltage side, wherein the diode conducts the secondary current when a primary current is cut off, the diode cuts off the secondary current when the primary current starts to flow;

a current detecting device connected in series to the secondary winding and the spark plug; and a supplied voltage limiting device holding a voltage applied to the current detecting device below a predetermined value when the firing voltage is generated, wherein an ionized current generating voltage is supplied to the secondary winding by a residual energy when the residual energy remains in the ignition coil after the spark discharge, the current detecting device detects a current in proportion to the ionized current, which is generated when the ionized current generating voltage is supplied to the spark plug.

8. The ignition apparatus for internal combustion engine according to claim 7, wherein the current detecting device includes a detecting resistor, one end thereof is connected to the low voltage side, the other end thereof is connected to a ground, and the current detecting device detects a current in proportion to the ionized current by using a voltage supplied to the detecting resistor.

9. The ignition apparatus for internal combustion engine according to claim 7, wherein he supplied voltage limiting device includes a Zener diode connected in parallel to the detecting resistor, an anode of the Zener diode links the low voltage side and the detecting resistor.

* * * * *